US008995672B2

(12) United States Patent
Poulsen et al.

(10) Patent No.: US 8,995,672 B2
(45) Date of Patent: Mar. 31, 2015

(54) SYSTEM AND METHOD FOR MICROPHONE POLARITY DETECTION

(75) Inventors: Jens Kristian Poulsen, Waterloo (CA); Mohamad El-Hage, Waterloo (CA)

(73) Assignee: Blackberry Limited, Waterloo (CA)

( * ) Notice: Subject to any disclaimer, the term of this patent is extended or adjusted under 35 U.S.C. 154(b) by 386 days.

(21) Appl. No.: 12/956,869

(22) Filed: Nov. 30, 2010

(65) Prior Publication Data

US 2012/0134503 A1 May 31, 2012

(51) Int. Cl.
*H04R 29/00* (2006.01)

(52) U.S. Cl.
CPC ..... *H04R 29/004* (2013.01); *H04R 2201/107* (2013.01); *H04R 2420/05* (2013.01)
USPC ..... 381/58; 381/74; 381/384; 381/394

(58) Field of Classification Search
USPC ..... 381/58, 394
See application file for complete search history.

(56) References Cited

U.S. PATENT DOCUMENTS

| | | | | |
|---|---|---|---|---|
| 7,248,707 | B2 | 7/2007 | Peng et al. | |
| 7,270,554 | B2 | 9/2007 | Corey et al. | |
| 7,349,546 | B2 | 3/2008 | Ganton | |
| 8,150,046 | B2 * | 4/2012 | Hansson et al. | 381/58 |
| 2005/0201568 | A1 | 9/2005 | Goyal | |
| 2007/0049103 | A1 * | 3/2007 | Kashi et al. | 439/396 |

FOREIGN PATENT DOCUMENTS

| | | |
|---|---|---|
| WO | 0060831 | 10/2000 |
| WO | 2006045617 | 5/2006 |

OTHER PUBLICATIONS

European Patent Office, Extended European Search Report for EP Patent App. No. 10193223.4, May 18, 2011.
European Patent Office, Examination Report for EP Patent App. No. 10193223.4, May 3, 2012.
European Patent Office, Examination Report (Oral Proceedings) for EP Patent App No. 10193233.4, May 27, 2013.
State Intellectual Property Office, Office Action for CN Patent App. No. 201110378057.1, Nov. 18, 2013.
Candian Intellectual Property Office, Office Action for CA Patent App. No. 2,759,143, Dec. 13, 2013.
Office Action dated Jun. 10, 2014, issued from the corresponding Chinese Patent Application. No. 201110378057.1.

* cited by examiner

*Primary Examiner* — Joseph Saunders, Jr.
*Assistant Examiner* — James Mooney
(74) *Attorney, Agent, or Firm* — Lesley M. Morrison; Borden Ladner Gervais LLP

(57) ABSTRACT

The present disclosure provides a method of determining microphone polarity in a headset. By being able to detect the polarity of the microphone within the headset, a portable electronic device may be compatible with any headset and is not limited to use with a specific headset. By applying a detection signal over one of lines within a headset cable, a return signal may be sensed on one of the other lines to determine which of the lines is the ground line and which line is the microphone line.

19 Claims, 10 Drawing Sheets

SYSTEM AND METHOD FOR MICROPHONE POLARITY DETECTION

FIELD OF THE DISCLOSURE

The present disclosure is generally directed at microphones and more specifically is directed at a method and system for microphone polarity detection.

BACKGROUND OF THE DISCLOSURE

Portable electronic device use has continued to increase over the years with new applications and functionality continually being incorporated within these devices. The introduction of these new applications and functionality require the devices themselves to be updated in order to handle new requirements associated with these applications and functionality.

In some portable electronic devices, a headset with a microphone is used to fully enhance the usability of these applications or functionality. In order to connect the headset with the device, the headset is typically connected via the insertion of a jack into a device port.

BRIEF DESCRIPTION OF THE DETAILED DRAWINGS

Embodiments of the present disclosure will now be described, by way of example only, with reference to the attached Figures, wherein.

DETAILED DESCRIPTION OF THE EMBODIMENTS

The following disclosure presents apparatus and techniques for handling polarity detection in microphones, typically within headsets for use with portable electronic devices.

Currently, portable electronic devices are designed to receive headsets that are designed to be compatible with the device in that the polarity of the microphone is known. Therefore, users are restricted to using headsets that are designed for a specific portable electronic device and the electronic device is unable to interact with other headsets. Therefore, headsets which are not implemented with the polarity that is being expected by the device may not be operational with the device.

By being able to determine the polarity of a microphone within a headset, portable electronic devices may be able to interact with any headset and is not limited to use with headsets which are specifically designed for the device.

Figure 1:
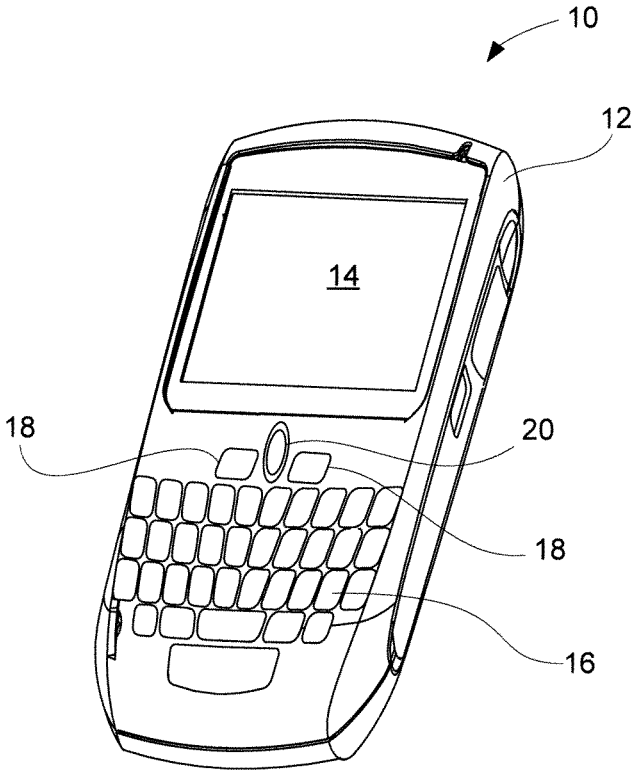
FIG. 1 is a schematic diagram of a portable electronic device.

Turning to FIG. 1, a schematic diagram of a portable electronic device, illustrated as a mobile communication device, is shown. The mobile communication device 10 has a body 12 which includes a display screen 14, a keyboard/keypad 16, a set of buttons 18 and a user-operated pointing or input device 20, such as a trackpad or a trackball. The user-operated pointing or input device may also be a joystick, scroll wheel, roller wheel, mouse or touchpad or the like, or another button. The mobile communication device 10 also includes at least one port for receiving a jack, but this is not shown in FIG. 1. The device 10 further includes other parts which are not shown or described. The device may be sized to be held or carried in the human hand.

Figure 2:
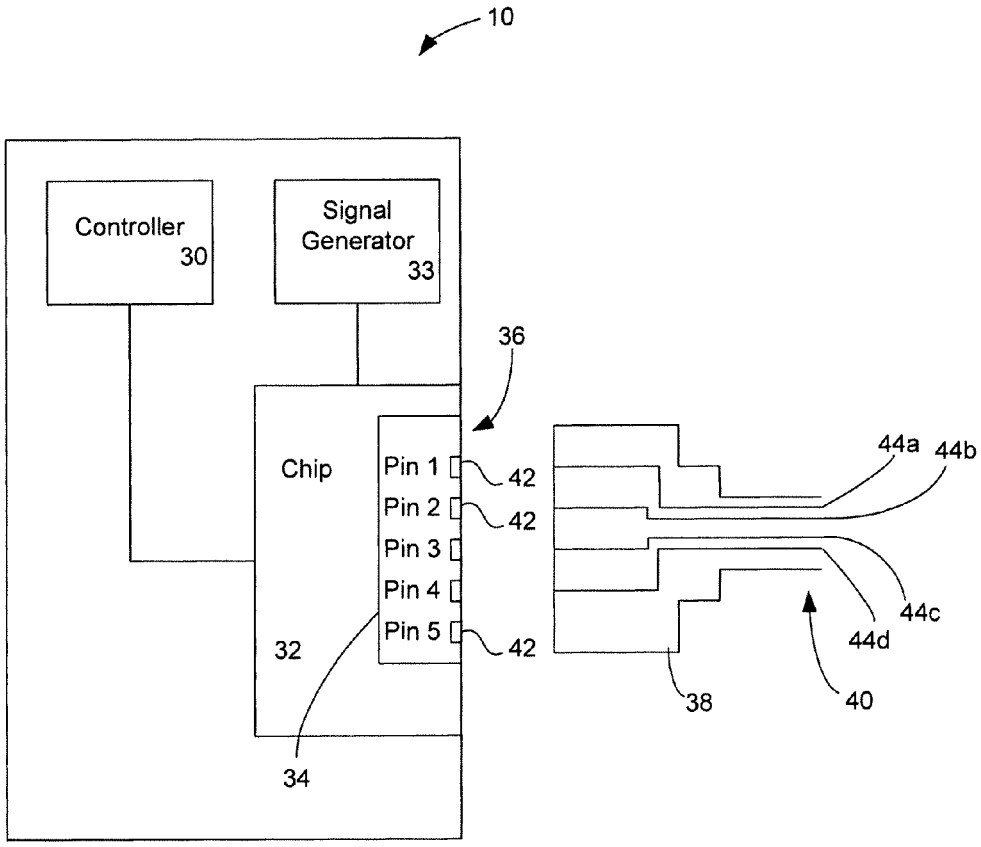
FIG. 2 is a more detailed schematic view of the portable electronic device.

Turning to FIG. 2, the mobile communication device 10 further includes a controller, or processor, 30 which is connected to a chip 32 which is integrated within the communication device 10. A signal generator, such as a voltage source, 33 is also connected to the chip 32. The chip 32 includes a switch matrix and jack configuration detect portion 34 which is integrated with a port 36 for receiving a jack 38 associated with a cable 40, such as a microphone/headset cable. The switch matrix 34 includes a plurality of individual input and output ports 42 for receiving and transmitting signals with corresponding wires 44 connected within the jack 38. The pin port PIN5 input detects the insertion of the cable by the opening or closing of a mechanical switch, when the plug or jack 38 is inserted. If pin port PIN5 is broken or absent, it is possible to detect the insertion of the cable by detecting a capacitance of the cable itself. As will also be discussed below, one or more contacts (such as pin port and a signal line) can be connected. In this context, "connected" refers not necessarily to physical contact or proximity—although the contacts may be physically close to or touching one another—but to the electrical connection whereby a signal in one contact results in a signal in the other. Such electrical connection may be completed or broken by affecting a current path (e.g., with the switch matrix 34) rather than by changing the physical relationship of one contact to another.

The wires or lines 44 within the jack 38 represent signal lines, such as audio lines, with one wire 44*a* representing a right audio or headphone line, one wire 44*b* representing a left audio or headphone line and then a pair of lines 44*c* and 44*d* providing a ground line and a microphone line. In an alternative embodiment, the jack may include only one audio line. In one embodiment, the ground line may be provided on the line 44*c* which is connected to pin port PIN3 and the microphone line provided on line 44*d* which is connected to port pin PIN4. The ground line is also connected to a ground reference voltage. In this context, ground is not necessarily earth potential, and a "ground line" need not be electrically connected to the Earth. Rather, ground basically connotes a node that is maintained at a reference voltage that is substantially constant with respect to other voltages.

In one embodiment of microphone polarity detection, the detection is achieved by sending out a detection signal, such as a AC or a DC signal, on the microphone line or on the ground line and receiving a return signal on one of the audio headphone lines. In another embodiment, the detection signal may be transmitted over an audio line and then the return signal sensed over either the ground line or the microphone line.

If the detection signal is being transmitted over one of the ground or microphone line, while the detection signal is being transmitted, the other of the ground or microphone line is kept at a different potential and the sensing of the return signal is on an audio line. In other words. if the detection signal is transmitted on the ground line, the microphone line is held at a potential different than the detection signal and a return signal can be sensed on at least one of the audio lines. If the detection signal is transmitted on the microphone line, the ground line is kept at a different potential, typically no return signal will be sensed on either of the audio lines. Similarly, if a detection signal is transmitted on an audio line, while the microphone line is kept at a steady potential, a return signal, or pulse can be sensed on the ground line. However, if the detection signal is transmitted over an audio line, and the ground line is grounded, no return signal will be sensed on the microphone line. This will described in more detail below.

Figure 3:
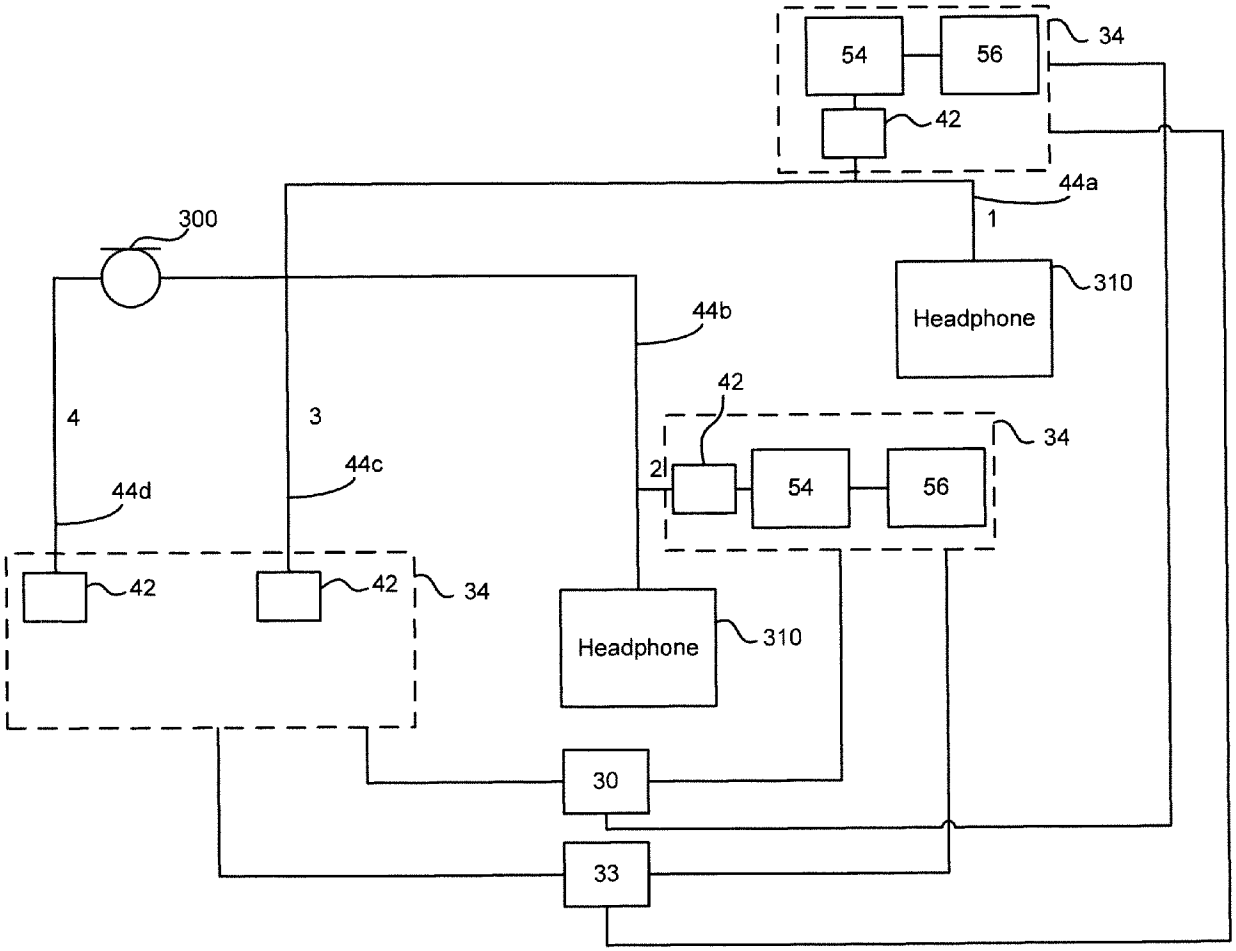
FIG. 3 is a schematic diagram of a system for polarity detection of a microphone within a headset.

Turning to FIG. 3, a more detailed schematic diagram of a system for polarity detection of a microphone 300 within a headset is shown. As shown, the four wires, or lines 44*a* to 44*d* of the jack are connected to the ports 42 of the switch matrix 34. The audio lines 44*a* and 44*b* are also connected to individual headphones 310 within the headset. Although shown with two headphones, the headset may include only one headphone. For the below description, where there is discussion of two headphones and therefore, two audio lines, the signals may be transmitted or sensed over a single audio line without affecting the apparatus or method of polarity detection. In other words, the headset may include only one headphone and one audio line but method of polarity detection may still be executed. Also, for headsets which include two headphones and two audio lines, the method of polarity detection may be executed using only one of the two headphones.

In the current embodiment, associated with each of the ports 42 connected to the audio lines 44*a* and 44*b*, are detectors 54 which are communicatively connected to the output of the lines 44*a* and 44*b* to monitor return signals being transmitted over the wires in response to one or more detection signals being transmitted over the one of the microphone line 44*d* or ground line 44*c* (as will be discussed in further detail below). In one embodiment, the detector 54 may be implemented as a low pass filter and a rectifier. In another embodiment, the detector is a pre-amplifier followed by a threshold detector. In another embodiment, the detector is a demodulator followed by a lowpass filter and a threshold detector. In another embodiment, the detector is a threshold detector. In one embodiment, the threshold detector can be implemented using a fixed threshold comparator. In another embodiment, the threshold detector can be implemented via an analog-to-digital converter (ADC) and a fixed digital threshold.

The detectors may be discrete components within the portable electronic device but in other embodiments, they are implemented on the chip 32. Each detector 54 is connected to a state machine 56, which may be located on the chip 32 or within the processor 30, to transmit signals representing the return signals or measurements recorded by the detectors 54. The state machine 56 processes or transmits the results of the sensed return signal or transmits results based on the signals sensed by its associated detector 54 to the processor 30 so that the processor may determine the polarity of the microphone 300. In general, the state machine 56 is a deciding circuit, which receives inputs from its associated detector 54, decides what condition or conditions are indicated by those inputs (such as whether a particular state is present or absent), then transmits a signal to the processor 30 as a function of that decision.

Figure 4:
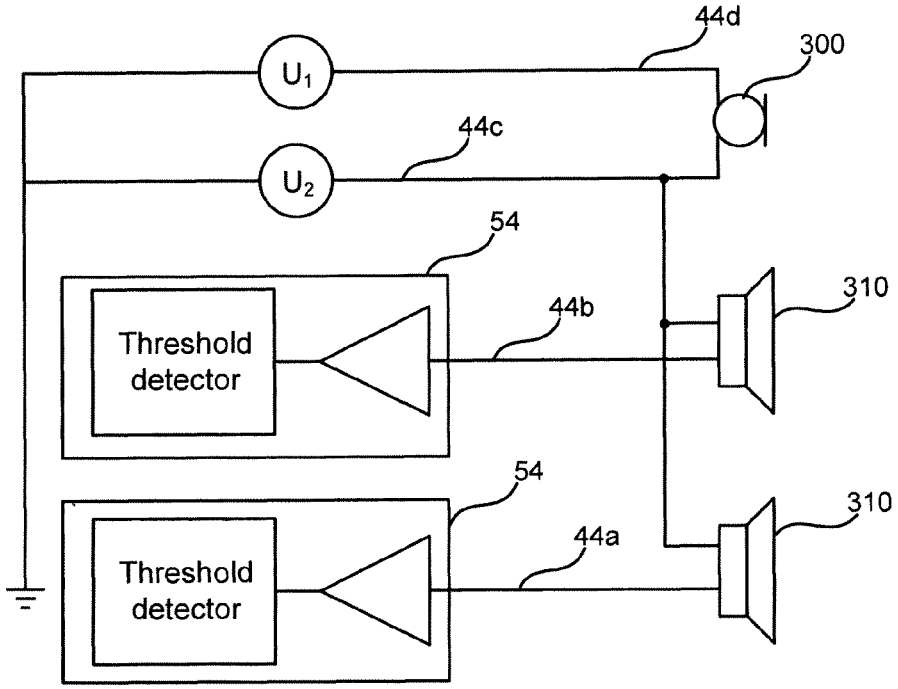
FIG. 4 is a schematic diagram of one embodiment of polarity detection.

As shown in FIG. 4, an example of polarity detection is shown. In this embodiment, the detection signal is transmitted over the microphone line 44*d* (or the line connected to pin port PIN4) and the return signal is sensed on the one or both of the headphone or audio lines 44*a* or 44*b*.

The detection signal, schematically represented by $U_1$ is either an AC signal or a DC signal while the ground line 44*c* is maintained at a different potential, schematically represented by $U_2$ where $U_2$ does not equal $U_1$.

After the transmission of the detection signal over the microphone line, the return signal may be sensed by one of the detectors 54 connected to at least one of the audio lines 44*a* or 44*b*. As disclosed above, in one embodiment, the detector 54 is integrated as part of the switch matrix 34, or the chip 32, but in another embodiment, may be located, or integrated within the headset. If the detector 54 is or detectors 54 are located within the headset, the headset communicates with the processor 30 to provide information concerning the return signal or signal(s) which are sensed.

Figure 5:
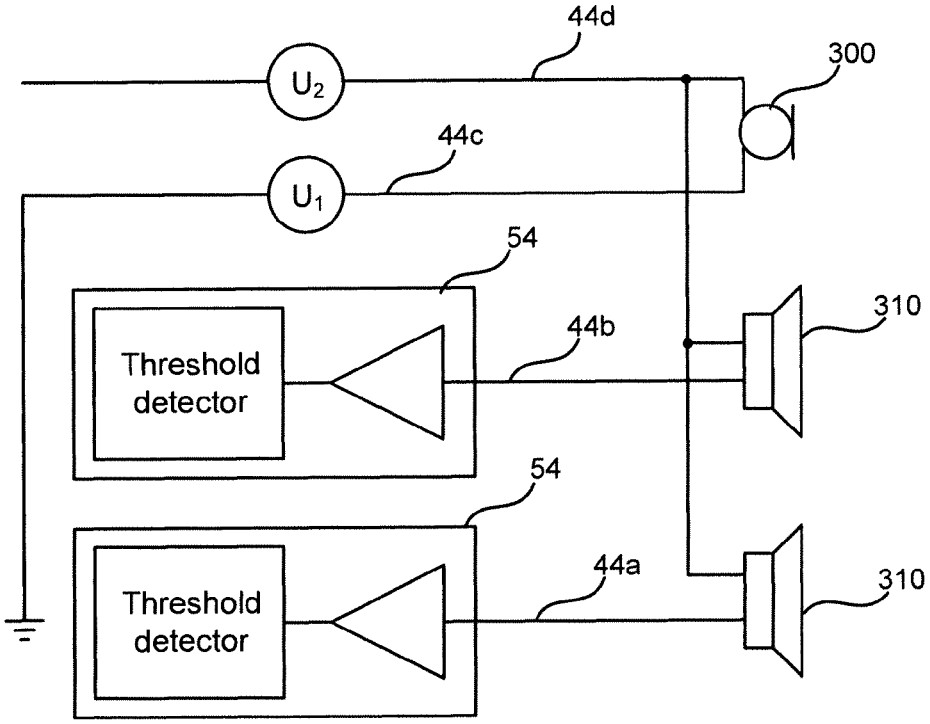
FIG. 5 is a schematic diagram of another embodiment of polarity detection.

As shown in FIG. 5, another example of polarity detection is shown. In this embodiment, the detection signal is transmitted over the ground line 44*c* (or the line connected to pin port PIN3) and the return signal sensed over at least one of the audio lines 44*a* or 44*b*.

The detection signal, schematically represented by $U_1$ is either an AC signal or a DC signal while the microphone line 44*d* is maintained at a different potential, schematically represented by $U_2$ where $U_2$ does not equal $U_1$. After the transmission of the detection signal over the microphone line, the return signal may be sensed by one of the detectors 54 connected to at least one of the audio lines 44*a* or 44*b*.

Figure 6:
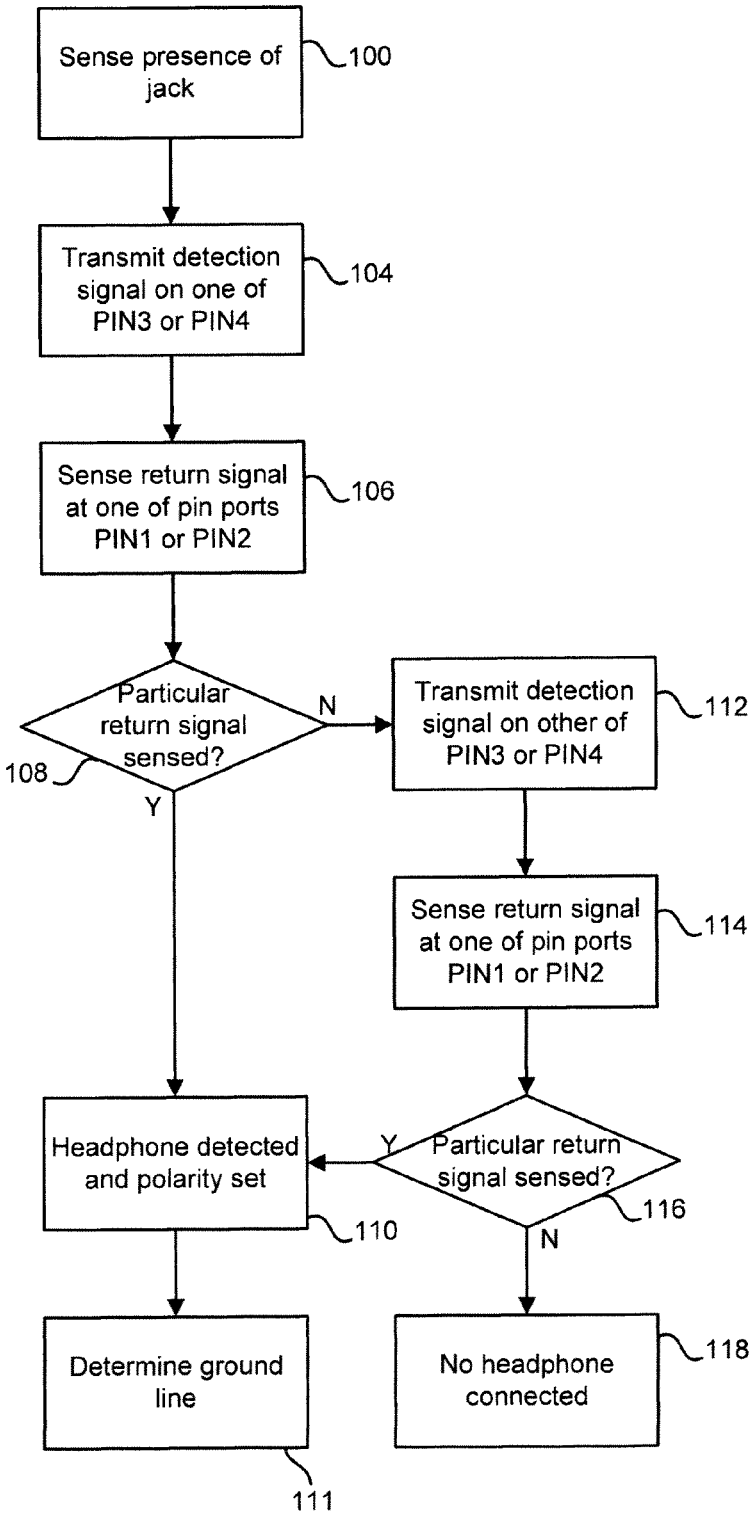
FIG. 6 is a flowchart outlining one method of detecting microphone polarity in a headset.

Turning to FIG. 6, a flowchart outlining a first method of microphone polarity detection is shown. In operation, from the cable point of view, voice signals are typically transmitted over the microphone line. However, when a jack is inserted into the port of the portable electronic device, it is not always known to which pin port, the microphone line is connected (from the portable electronic device point of view). The microphone line may be connected to either pin port PIN3 or pin port PIN4. This may be problematic since signals can not be transmitted over the ground line and therefore a determination is required to see over which pin port the audio signals are to be transmitted, or, in other words, the pin port which is connected to the microphone line. In the example below, the portable electronic initially assumes that the microphone line 44*d* is connected to pin port PIN4 and the ground line 44*c* is connected to pin port PIN3. However, depending on the results of the polarity detection, the opposite conclusion may be determined.

When the jack is inserted into the port, there is a line within the jack that corresponds with each of the pin ports 42 in the switch matrix 34. Typically, pin port PIN1 and pin port PIN2 receive the audio lines 44*a* and 44*b* which are characterized as Left audio and Right audio while pin port PIN5 is used for detecting the presence of the jack. With respect to pin ports PIN3 and PIN4, one of these pin ports is connected to the ground line while the other is connected to the microphone line.

In one embodiment, the method is initiated once the insertion of the jack of the headset cable into the port is sensed 100 whereby the individual lines 44 are connected to associated pin ports. In one embodiment, this is achieved by detecting the presence of the jack 38 on pin port PIN5 of the switch matrix and jack configuration detect portion 34. Alternatively, internal device logic may assist in determining or may determine when the jack is inserted based on the capacitance of the cable itself or by the coupling between some of the lines 44. In this configuration, it is possible to detect the insertion of the headset, even if the pin port PIN5 is non-functional or not existent.

After the presence of the jack is sensed 100, a detection signal, either AC or DC, is transmitted 104 over one of pin port PIN3 or pin port PIN4. In accordance with various embodiments, the AC or DC signal is generated and transmitted by the signal generator 33. The detection signal is then propagated through the cable 40. The detection signal may be a sine wave or a square wave although other signals are contemplated. While the detection signal is transmitted over one of the lines connected to pin port PIN3 or pin port PIN4, the other of the lines is connected to a known potential, such as a ground potential or ground reference voltage The transmission of the detection signal may result in activity on the audio lines 44*a* and 44*b* in response to the signal, which is measured as a return signal or a measured output voltage. The return signal or signals transmitted over the audio lines (lines 44*a* and 44*b*) are then sensed 106 or read over pin port PIN1 and/or pin port PIN2 by the associated detectors 54. In one embodiment, the audio lines 44*a* and 44*b* are kept in a high impedance (tri-state) mode when the return signal is sensed in order to minimally affect the measurement. In order for the signal to minimally disturb the user of the headset, a detection signal of low amplitude or signals that are outside the audible bandwidth may be used.

From these return signals, or measurements, the polarity of the microphone or headset may be determined. In order to determine if the signal has been transmitted over the ground line (from the portable electronic device point of view), a check is performed to determine if a particular return signal is sensed, or measured, 108 on one of the audio lines. If a particular return signal is sensed, it can be concluded 110 that a headset, or headphone and microphone combination, has been connected to the switch matrix 34. In this embodiment, the particular return signal may be a signal which substantially corresponds to, substantially matches or is comparable in magnitude with the detection signal or a signal which is above a threshold with respect to the detection signal.

The polarity of the microphone can then be determined. As signals have a very good coupling to the audio lines through the ground line and the headphones themselves, if the particular return signal is sensed on one of the audio lines, it can be determined 111 that the line over which the detection signal was transmitted is the ground line. This determination may be achieved with the assistance of the state machines. In one embodiment of the state machine, if the return signals from both detectors 54 are above a certain threshold (with reference to the transmitted sensed signal), the state machine receives these signals and transmits a signal to the processor indicating if a condition was met, such as, but not limited to, if the particular return signal was sensed on an audio line. Alternatively, the state machine may transmit a signal indicating which of lines 44*c* or 44*d* is the ground line by confirming that the particular return signal was sensed. The state machine may also directly configure the switch matrix 34 to identify the ground and microphone lines without intervention from the processor. In other words, it may be determined that the output of the state machine corresponds to a 1 and therefore, it may be concluded that the detection signal was transmitted over the microphone line. Alternatively, it may be determined that the output of the state machine corresponds to a 0 and therefore, it may be concluded that the detection signal was transmitted over the microphone line.

The processor may then receive the status of the pin selection, or information concerning which pin port is connected to which line, by an interrupt or logic pin signaling an event or the processor can poll the electronic device or the chip 32 to ask for status, such as, but not limited to the status of the lines. In either case, the determination of the ground line (and therefore the microphone line) can either be made automatically by the state machine or by the processor if the particular return signal is sensed.

The polarity of the microphone the headset may then be stored in the processor, or other components, or the switch matrix automatically configured for correct ground connection, so that the signals from the device may be corrected transmitted to the headset.

Alternatively, if the particular return signal is not sensed, or measured, at 108, another detection, or a second detection, signal is then transmitted 112 over the other of the line between pin ports PIN3 and PIN4. The line over which the detection signal is not transmitted is set to a known potential, such as a ground potential by connecting the line to a ground reference voltage. Once again, the output of at least one of the audio lines is sensed 114 to determine if a particular return signal is sensed. A check is then performed to determine 116 if the particular return signal is sensed such that the output of the at least one audio line substantially corresponds with the detection signal. If the particular return signal is sensed, it can be determined 110 that a headset, or headphone and microphone combination, has been connected to the switch matrix 34 or device. The polarity of the microphone can then be determined 111 as discussed above. The polarity of the microphone within the headset is then stored in the processor, or other components, or the switch matrix is automatically configured for correct ground connection, so that the signals from the device may be corrected transmitted to the headset.

If the particular return signal is not sensed in any of the cases, it can be concluded 118 that no headset is connected. In this case, the cable that has been inserted into the jack may be, but is not limited to, a microphone without a headset, or a microphone extension cable.

Figure 7:
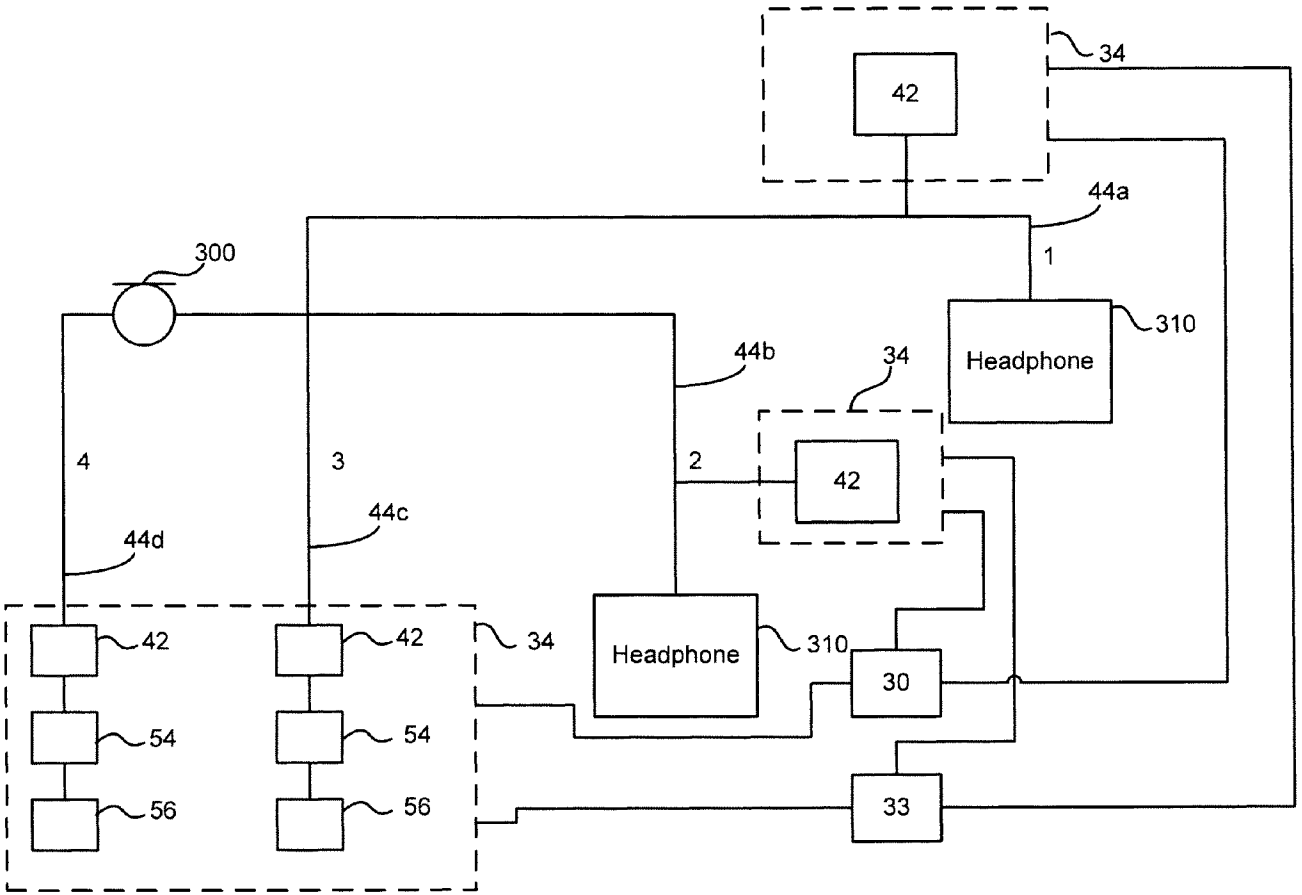
FIG. 7 is a schematic diagram of another embodiment of a system for polarity detection of a microphone within a headset.

Turning to FIG. 7, a more detailed schematic diagram of another embodiment of apparatus for the polarity detection of a microphone 300 within a headset is shown. As shown, the four wires, or lines 44*a* to 44*d* are connected to the ports 42 of the switch matrix 34. The audio lines 44*a* and 44*b* are connected to individual headphones 310. As with the previous embodiment, there may be only one headphone and therefore only one audio line. In the current embodiment, associated with each of the ports 42 connected to the microphone line 44*d* and the ground line 44*c* are detectors 54 which are communicatively connected to the output of the lines 44*c* and 44*d* to monitor return signals being transmitted over the wires in response to one or more detection signals transmitted over one of audio lines 44*a* or 44*b* (as will be discussed in further detail below). Each of the detectors 54 may be implemented in any of the manners discussed or via any detection circuitry or components. The detectors can be discrete components within the portable electronic device but may also be implemented on the chip 32. Each detector 54 is connected to a state machine 56, which may also be located on the chip 32 or within the processor 30, to transmit signals representing the sensed return signals, or measurements recorded by the detectors 54. The state machine 56 transmits signals representing the conditions met by the return signal sensing by its associated detector 54 to the processor 30 so that the processor can determine the polarity of the microphone 300. Alternatively, the state machine may transmit a signal indicating which of the microphone line and the ground line (from the point of view of the portable electronic device) is the actual ground line or the actual microphone line.

Figure 8:
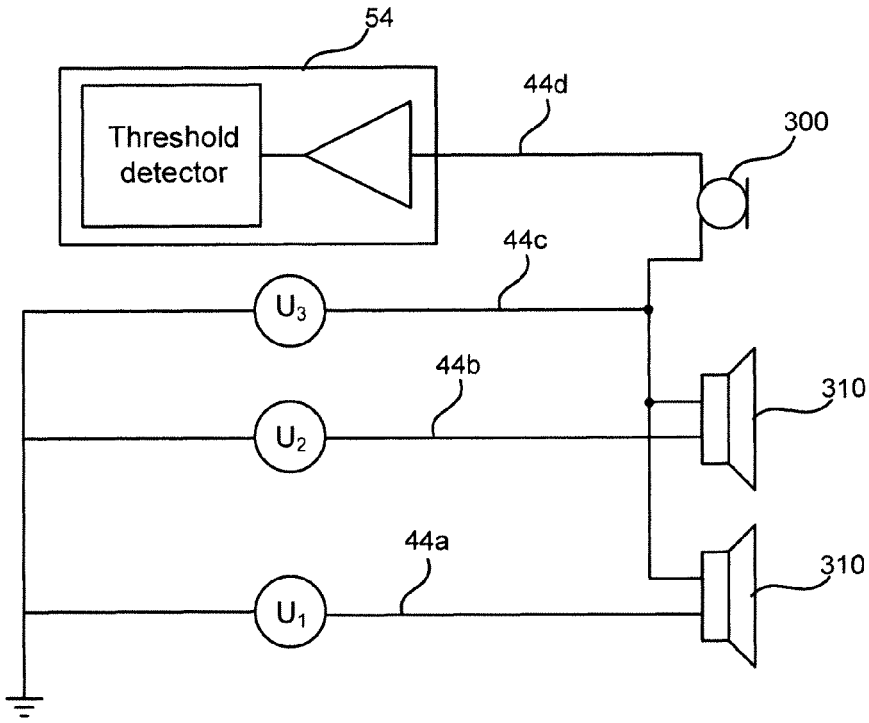
FIG. 8 is a schematic diagram of an embodiment of polarity detection.

As shown in FIG. 8, an example of polarity detection is shown. In this embodiment, the detection signal is transmitted over one of the audio lines, such as the left audio line 44*a* and the return signal is sensed on the microphone line 44*d* (from the point of view of the portable electronic device).

The detection signal, schematically represented by $U_1$ is either an AC signal or a DC signal while the other audio line 44*b* is maintained at a different potential or tri-stated, schematically represented by $U_2$. The ground line 44*c* (or the line that is not being sensed for the particular return signal), is driven to a known potential, schematically represented by $U_3$, such as a ground potential.

After the transmission of the detection signal over the left audio line, the particular return signal may be sensed by the detectors 54 connected to the microphone line to assist in determining the polarity of the microphone 300 within the headset. In another embodiment, the detection signal may be transmitted over the right audio line 44*b* with the potential of the left audio line 44*a* held at the same potential level or tri-stated.

Figure 9:
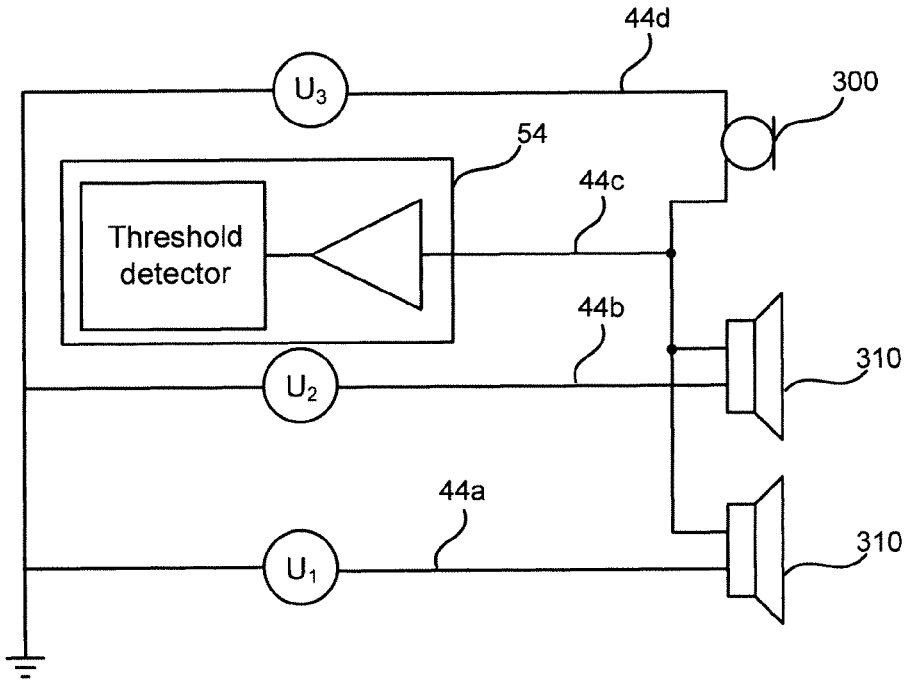
FIG. 9 is a schematic diagram of another embodiment of polarity detection.

As shown in FIG. 9, another example of polarity detection is shown. In this embodiment, the detection signal is transmitted over one of the audio lines, such as the left audio line 44*a*, and the return signal sensed on the ground line 44*c* (from the point of view of the portable electronic device).

The detection signal, schematically represented by $U_1$ is either an AC signal or a DC signal while the other audio line 44*b* is maintained at a different potential or tri-stated, schematically represented by $U_2$. The microphone line 44*d* (or the line that is not being sensed for the particular return signal), is driven to a known potential, schematically represented by $U_3$, such as a ground potential.

After the transmission of the detection signal over the audio line, the particular return signal may be sensed by the detector 54 connected to the ground line to assist in determining the polarity of the microphone 300 within the headset. In another embodiment, the detection signal may be transmitted over the right audio line 44*b*.

Figure 10:
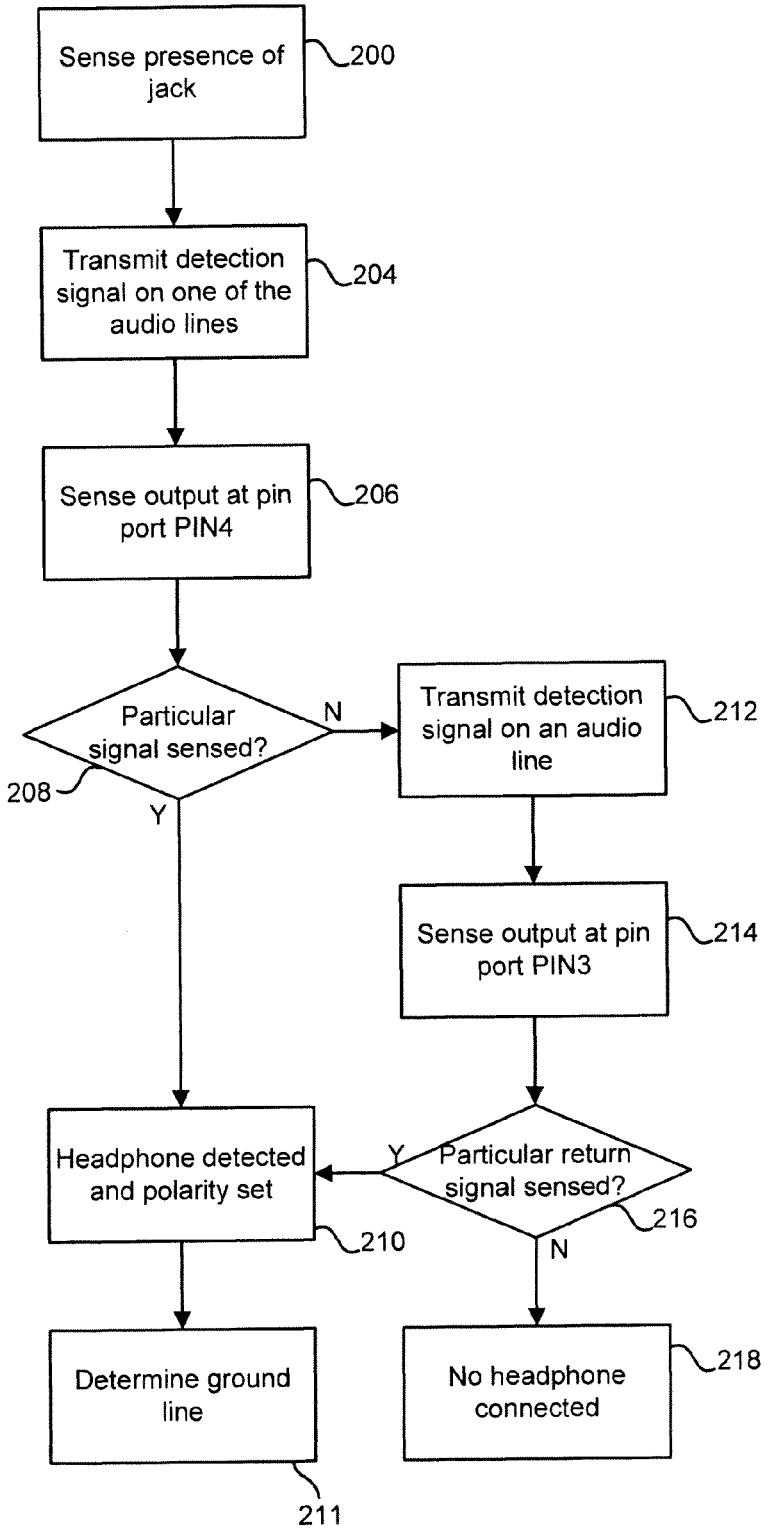
FIG. 10 is a flowchart outlining a second method of detecting microphone polarity.

Turning to FIG. 10, a flowchart outlining another method of microphone polarity detection is shown. In operation, from the cable point of view, voice signals are typically transmitted over the microphone line. However, when a jack is inserted into the port of the portable electronic device, it is not always known to which PIN port, the microphone line is connected (from the portable electronic device point of view). The microphone line may be connected to either pin port PIN3 or pin port PIN4. This may be problematic since signals can not be transmitted over the ground line and therefore a determination is required to see over which pin port the audio signals are to be transmitted, or, in other words, the pin port which is connected to the microphone line. In the example below, the portable electronic initially assumes that the microphone line 44*d* is connected to pin port PIN4 and the ground line 44*c* is connected to pin port PIN3. However, depending on the results of the polarity detection, the opposite conclusion may be determined.

In one embodiment, when the jack is inserted into the port, there is a line within the jack that corresponds with each of the pin ports 42 in the switch matrix 34. However, there may be embodiments where the headset includes only one headphone and therefore, one of pin port PIN1 or pin port PIN2 may not be used. Typically, pin port PIN1 and pin port PIN2 receive the audio lines 44*a* and 44*b* which are characterized as audio lines while pin port PIN5 is used for detecting the presence of the jack. With respect to pin ports PIN3 and PIN4, one of these pin ports is connected to the ground line while the other is connected to the microphone line.

In one embodiment, the method is initiated once the insertion of the jack of the headset cable into the port is sensed 200 whereby the individual lines 44 are connected to associated pin ports. Some methods of sensing of the presence of the jack are discussed above.

After the presence of the jack is sensed 200, a detection signal, either AC or DC, is transmitted 204 over one of the audio lines pin port PIN3 or pin port PIN4. In one embodiment, the AC or DC signal is generated and transmitted by the signal generator 33. The detection signal is then propagated through the cable 40. The detection signal may be a sine wave or a square wave although other signals are contemplated.

The transmission of the detection signal may result in activity, in the form of a return signal on microphone line 44*d* or the ground line 44*c* in response to the detection signal, which is measured as a return signal, or measured output voltage. In one embodiment, while the ground line (or line connected to pin point PIN3) is held at a known potential, such as a ground potential, the return signal transmitted over the microphone line is sensed 206 or read over pin port PIN4 by the associated detector 54. The microphone line 44*d* is kept in a high impedance (tri-state) mode when the measurements are taken in order to minimally affect the measurement.

From these return signals, or measurements, the polarity of the microphone or headset can be determined. In order to determine which line the detection signal has been transmitted over, a check is performed to determine if a particular return signal is sensed 208 on the microphone line 44*d* (or the line connected to pin port PIN4). If a particular return signal is sensed, it can be concluded 210 that a headset, or headphone and microphone combination, has been connected to the switch matrix 34. In this embodiment, the particular return signal may be a signal which substantially corresponds to, substantially matches or is comparable in magnitude with the detection signal or above a threshold with respect to the detection signal.

If the particular return signal is sensed on the microphone line 44*d*, it can be determined 211 that this line is in fact the ground line and the ground line (from the initial assumption of the portable electronic device) is the microphone line. As discussed above, this determination may also be performed with the state machine 56. The polarity of the microphone within the headset is then stored in the processor, or other components, or the switch matrix is automatically configured for correct ground connection, so that the signals from the device may be corrected transmitted to the headset.

Alternatively, if the particular return signal is not sensed at 208, another detection, or a second detection signal is then transmitted 212 over one of the audio lines 44*a* or 44*b*. The output of the ground line (from the viewpoint of the portable electronic device) or the line connected to pin port PIN3, is then sensed 214. A check is then performed to determine 216 if the particular return signal is sensed on the ground line. If the particular return signal is sensed, it can be concluded 210 that a headset, or headphone and microphone combination, has been connected to the switch matrix 34. The polarity of the microphone can then be determined 211 as discussed above whereby the line connected to pin port PIN3 is the ground line and the line connected to pin port PIN4 is the microphone line. If the particular return signal is not sensed in any of the cases, it can be concluded 218 that no headset is connected. In this case, the cable that has been inserted into the jack may be, but is not limited to, a microphone without a headset, or a microphone extension cable.

In an alternative embodiment, detectors 54 may be associated with each of the lines and depending on which line the detection signal is transmitted, the detector for specific lines may or may not be activated for the sensing of the particular return signal or the polarity detection.

In the preceding description, for purposes of explanation, numerous details are set forth in order to provide a thorough understanding of the embodiments of the disclosure. However, it will be apparent to one skilled in the art that some or all of these specific details may not be required in order to practice the disclosure. In other instances, well-known electrical structures and circuits are shown in block diagram form in order not to obscure the disclosure. For example, specific details are not provided as to whether the embodiments of the disclosure described herein are as a software routine, hardware circuit, firmware, or a combination thereof.

The above-described embodiments of the disclosure are intended to be examples only. Alterations, modifications and variations can be effected to the particular embodiments by those of skill in the art without departing from the scope of the disclosure, which is defined solely by the claims appended hereto.

We claim:

1. A method of determining microphone polarity in a headset, the headset including at least one audio line, a ground line and a microphone line, the method comprising:

connecting one of the ground or microphone line to a ground reference voltage;

transmitting a first detection signal over the other of the ground or microphone lines;

measuring a first return signal of the at least one audio line; and determining the actual ground line based on the first return signal by comparing the first return signal with the first detection signal.

2. The method of claim 1 further comprising:

detecting a presence of the headset before connecting one of the ground or microphone signal line to the ground reference voltage.

3. The method of claim 1 wherein the ground line is determined to be the line over which the first detection signal was transmitted if the first return signal substantially corresponds to the first detection signal.

4. The method of claim 1 wherein if the first return signal does not substantially correspond to the first detection signal, further comprising:

connecting the other of the ground or microphone line to the ground reference voltage;

transmitting a second detection signal over the line which was originally connected to the ground reference voltage;

measuring a second return signal of the at least one audio; and determining if the second return signal substantially corresponds to the second detection signal.

5. The method of claim 4 wherein the ground line is determined to be the line over which the second detection signal was transmitted if the second return signal substantially corresponds to the second detection signal.

6. The method of claim 4 wherein there is determined to be no microphone connected if the second return signal does not substantially correspond to the second detection signal.

7. The method of claim 1 wherein determining the ground line comprises:

transmitting the first return signal to a state machine;

receiving an output of the state machine; and determining over which line the first detection signal was transmitted.

8. The method of claim 7 wherein if the output of the state machine corresponds to a 1, the line over which the first detection signal was transmitted is determined to be the microphone line.

9. The method of claim 7 wherein if the output of the state machine corresponds to a 0, the line over which the first detection signal was transmitted is determined to be the microphone line.

10. A system for detecting microphone polarity within a headset when a headset cable has been inserted into a mobile device communication port, the cable including at least one audio line, a ground line and a microphone line, the system comprising:

a switch matrix and jack detect;

a set of pin ports located within the switch matrix for receiving the at least one audio line, the ground line and the microphone line;

a signal generator for transmitting a detection signal;

a set of detectors for detecting return signals of the at least one audio line in response to transmission of the detection signal; and a processor for detecting the ground line based on the return signals sensed by the set of detectors by comparing the return signals with the detection signal;

wherein after the cable is sensed, one of the ground line or the microphone line is connected to a ground reference voltage and the detection signal is transmitted over the other of the ground or microphone line.

11. The system of claim 10 wherein the set of pin ports includes a port for detecting a presence of the cable.

12. The system of claim 11 wherein the presence of the cable is sensed by measuring a parasitic capacitance of the cable between at least one of the lines and the ground reference voltage.

13. The system of claim 10 further comprising:

apparatus for receiving the outputs from the set of detectors and for transmitting a result of the outputs to the processor.

14. The system of claim 10 further comprising:

apparatus for automatically receiving the outputs from the set of detectors and for transmitting a result of the outputs to the processor.

15. A method of determining microphone polarity in a headset, the headset including at least one audio line, a ground line and a microphone line, the method comprising:

connecting one of the ground line or the microphone line to a ground reference voltage;

transmitting a first detection signal over one of the at least one audio line;

measuring a first return signal over the other of the ground line or the microphone line which is not connected to the ground reference voltage; and determining the ground line based on the first return signal by comparing the first return signal with the first detection signal.

16. The method of claim 15 wherein if the first return signal does not substantially correspond to the first detection signal, further comprising:

connecting the other of the ground or microphone line to the ground reference voltage;

transmitting a second detection signal over the line which was originally connected to the ground reference voltage;

measuring a second return signal of the at least one audio; and determining if the second return signal substantially corresponds to the second detection signal.

17. The method of claim 16 wherein the ground line is determined to be the line over which the second detection signal was transmitted if the second return signal substantially corresponds to the second detection signal.

18. The method of claim 16 wherein there is determined to be no microphone connected if the second return signal does not substantially correspond to the second detection signal.

19. A mobile communication device comprising:

a computer program product, including a computer usable medium having a computer readable program code embodied therein, said computer readable program code adapted to be executed to implement a method for determining microphone polarity in a headset, the headset including at least one audio line, a ground line and a microphone line, said method comprising:

connecting one of the ground or microphone line to a ground reference voltage;

transmitting a first detection signal over the other of the ground or microphone lines;

measuring a first return signal of the at least one audio line; and determining the actual ground line based on the first return signal by comparing the first return signal with the first detection signal.

* * * * *